United States Patent [19]

Clausing et al.

[11] 4,421,807

[45] Dec. 20, 1983

[54] SHEET-LIKE SEALING WEB

[75] Inventors: Rüdiger Clausing, Neckargemünd; Werner Schunter, Lobenfeld, both of Fed. Rep. of Germany

[73] Assignee: Teroson GmbH, Heidelberg, Fed. Rep. of Germany

[21] Appl. No.: 351,791

[22] Filed: Feb. 24, 1982

[30] Foreign Application Priority Data

Feb. 26, 1981 [DE] Fed. Rep. of Germany ... 8105299[U]
Jul. 14, 1981 [DE] Fed. Rep. of Germany ... 8120644[U]

[51] Int. Cl.[3] ..... B32B 3/06

[52] U.S. Cl. ..... 428/41; 428/77; 428/192; 428/193; 428/194; 428/247; 428/262; 428/332; 428/489; 428/343; 428/344; 428/351; 428/354

[58] Field of Search ..... 428/41, 40, 77, 78, 428/192, 193, 194, 343, 344, 351, 354, 489, 247, 262, 332

[56] References Cited

U.S. PATENT DOCUMENTS

| | | | |
|---|---|---|---|
| 3,532,586 | 10/1970 | Haurey et al. | 161/113 |
| 3,900,102 | 8/1975 | Hurst | 206/411 |
| 4,022,248 | 5/1977 | Hepner et al. | 138/141 |
| 4,039,706 | 8/1977 | Tajima et al. | 428/40 |
| 4,091,135 | 5/1978 | Tajima et al. | 428/489 X |
| 4,157,410 | 5/1979 | McClintock | 428/40 |
| 4,172,830 | 10/1979 | Rosenberg et al. | 428/245 |
| 4,215,160 | 7/1980 | Rosenberg et al. | 427/177 |
| 4,248,926 | 2/1981 | Tajima et al. | 428/489 X |

FOREIGN PATENT DOCUMENTS

| | | |
|---|---|---|
| 2510162 | 9/1976 | Fed. Rep. of Germany . |
| 7907342 | 7/1979 | Fed. Rep. of Germany . |
| 1230753 | 5/1971 | United Kingdom . |

OTHER PUBLICATIONS

Zonolite® Roof Deck Insulation–Brochure No. 7.15Ge (1980), W. R. Grace & Co.
CRM® Self-Adhesive Roof Systems–Brochure No. 7.1Gr (1980), W. R. Grace & Co.
KMM TM Koppers Roofing & Waterproofing (1976) Trade Brochure of Koppers Co.

*Primary Examiner*—Alexander S. Thomas
*Attorney, Agent, or Firm*—John H. Wasatonic; William L. Baker

[57] ABSTRACT

A sheet-like sealing web for use in construction above and under ground comprises a resilient elastic pressure-sensitive adhesive and sealing composition enclosed between two flexible layers, said lower layer not covering the sealing composition in the vicinity of one longitudinal edge of the web and said upper layer not covering the sealing composition in the vicinity of the opposite longitudinal edge of the web, thus forming two exposed sealing strips for bonding the webs to each other in an overlapping position. The novel sealing web can be further modified so that the adhesive and coating composition is not covered by said upper and said lower flexible layer in a narrow area along the longitudinal edges of the web opposite to the sealing strips, thus forming two exposed fixation strips for securing the web to a substrate or for bonding a cover material to the sealing web.

9 Claims, 2 Drawing Figures

SHEET-LIKE SEALING WEB

BACKGROUND OF THE INVENTION

The invention relates to a sheet-like waterproof sealing web, which is suitable for use in construction above and under ground.

It is known to use plastic sheets as sealing materials by placing the sheet-like webs in overlapping manner on a substrate, whilst placing a strip or tape of pressure-sensitive profiled adhesive compound, e.g. butyl rubber between the sheets for joining the webs in the overlapping area. The necessary adhesive tape is placed between two layers of non-adhering protective foil, e.g. siliconized paper, for transportation, handling and during storage.

German Offenlegungsschrift No. 25 10 162 describes a sheet-like rubber sealing material which is provided with an adhesive tape during its manufacture. One adhesive tape is applied along one longitudinal edge on the upper surface and a further adhesive tape is provided at the opposite longitudinal edge at the upper side of the web. The adhesive tapes may be protected by a silicone paper.

The sheets of sealing material can also be welded by solvents or by heating. However, the application of such sealing webs is very complicated and time-consuming and even slight impressions when inserting the adhesive tape or during welding in the overlapping area can lead to an untight joint. German Offenlegungsschrift No. 1 621 939 discloses sealing materials comprising a flexible film laminated with a pressure-sensitive adhesive and sealing compound. The preferred material for the sealing compound is a bitumen/rubber composition. This material is also applied in web-like overlapping manner in such a way that the adhesive sealing compound adheres to the substrate to be sealed and is protected by the covering film. In the overlapping area, the adhesive and sealing compound of the upper web rests on the covering film of the lower web, so that a bond is obtained between the compound and the film. If the webs are not laid completely smoothly, e.g. due to an unevenness of the substrate or in the case of stresses due to temperature fluctuations, there can be an incomplete bond between the sealing compound and the film in the overlapping area and capillaries can form through which water can penetrate.

U.S. Pat. No. 4,172,830 discloses a modification of the above material according to which the pressure-sensitive adhesive membrane is laminated with a flexible support sheet with a non-adhering outer surface. A minor portion of the pressure-sensitive adhesive membrane along one edge of the sheet-like material is covered with a flexible film which is non-adherent on both surfaces and may therefore be removed when applying the sealing material to a substrate. An overlapping application will therefore result in an adhesive to adhesive bonding. Due to its non-adherent properties it is not possible to apply a further adhesive material on top of the sealing material. In addition, it is not possible to use bitumen-coated sealing webs everywhere, for example they are not suitable for laying on certain thermal insulating materials which are being increasingly used in the completion of interiors and for roof coverings.

SUMMARY OF THE INVENTION

It is the object of the invention to develop a sealing web having not only the advantages of conventional materials, but which can also be applied in a trouble-free easy manner, whilst providing a completely waterproof layer. The invention is more particularly intended to provide a reliably tight, homogeneous joint in the overlapping area of the sealing webs. The material is applicable to all types of substrates and further adhesive materials may be applied on top of it.

The invention relates to a sheet-like sealing web for use in construction above and under ground comprising a resilient elastic pressure-sensitive adhesive and sealing composition enclosed between two flexible layers, said lower layer not covering the sealing composition in the vicinity of one longitudinal edge of the web and said upper layer not covering the sealing composition in the vicinity of the opposite longitudinal edge of the web, thus forming two exposed sealing strips for bonding the webs to each other in an overlapping position.

In a preferred embodiment of the sealing web the adhesive and sealing composition is not covered by said upper and lower flexible layer in a narrow area along the longitudinal edges of the web opposite to the sealing strips, thus forming two exposed fixation strips for securing the web to a substrate or for bonding a cover-material to the sealing web.

DETAILED DESCRIPTION OF THE INVENTION

Figure 1:
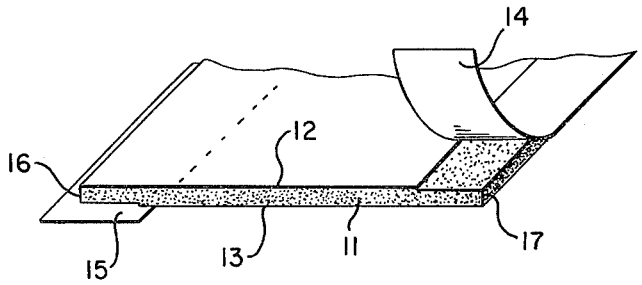

Bitumen/rubber mixtures are suitable as the adhesive and sealing compound, their excellent temperature characteristics being particularly important. They can still be bent by 180° down to −30° C. and even at temperatures of +80° still show no plastic flow, i.e. they have an adequate thermal stability. It is possible to lay the sealing webs at temperatures as low as about 0° C., because the pressure-sensitive adhesive properties of the sealing compound are adequate for a homogeneous joint. A suitable sealing compound for the sealing web according to the invention is formed e.g. from 40 to 80 parts by weight of bitumen (softening temperature 60° to 100° C. according to DIN 1995), 15 to 45 parts of aromatic oil and 5 to 15 parts of rubber, e.g. styrene/-butadiene copolymer. The layer thickness of the adhesive and sealing compound is approximately 0,5 to 3 mm, preferably between 1 and 2 mm, particularly about 1,5 mm.

The sheets are preferably made from polyethylene, polyvinyl-chloride or fluoride, EPDM rubber, butyl rubber, chloroprene or natural rubber, i.e. materials with an adequate elasticity, which do not tear or break even under high mechanical or thermal stresses. Optionally, the sheets can be reinforced with glass fibres. Particular preference is given to polyolefin film, i.e. film formed from polyethylene or polypropylene, as well as laminated sheets of polyethylene or polethylene/polypropylene which may be mono- or biaxially oriented. The thickness of the sheets is between 40 and 500, preferably between 60 and 200 and more especially approximately 100 microns. When using laminated sheets, it is possible to laminate two sheets with a thickness of in each case 50 microns.

For certain purposes metal sheets are suitable although they have a lower elasticity. When using metals, e.g. aluminum or copper, it is particularly advantageous to use metal-deposited plastic sheets or laminated metal/plastic sheets, e.g. an aluminum foil between two polyethylene sheets. Such sheets are characterized by a particularly good moisture impermeability which makes them very suitable e.g. for use in cold store houses.

The sealing web according to the invention can also be constructed in such a way that the upper flexible layer is formed by a film and the lower layer by a non-woven fabric. In this way, a sealing web is obtained which can be bonded to a substrate in a much more advantageous manner than a plastic foil by means of adhesives and this can be particularly desirable if, after laying, a weight has to be applied to the sealing webs, e.g. in the form of small gravel. Another possibility is for the lower flexible layer of the sealing web according to the invention to comprise a metal wire or fabric screen so that by pressing into the substrate thorough adhering can be achieved (zonal self-bonding with the substrate). In the seam or overlapping area between the webs, the homogeneous, tight joint is obtained in all these cases through one self-adhesive lateral area being positioned over another. The lower flexible layer may also be a film lined with a non-woven fabric.

The sealing webs according to the invention can be produced and used in different widths. A favourable width is approximately 0.9 to 1.2 m. The width of the adhesive area on the upper face of the web along one side and the lower face along the opposite side should be up to 10 cm, e.g. approximately 2 to 8, particularly 4 to 7 but especially 7 to 8 cm. Compared with the materials of DE-OS 1 621 939 it is an additional advantage of the sealing web according to the invention that the overlapping area can have a smaller width, because a particularly homogeneous and tight joint is obtained by the meeting of two areas with the pressure-sensitive sealing compound.

The fixation strips along the edges opposite to the sealing strips are normally of considerably smaller width. Accordingly the fixation strips have preferably a width of about 0.5 to 2, especially about 1 cm. The fixation strip serves to secure the sealing webs to the substrate without additional means which considerably simplifies the application of the material. The fixation strip at the upper side of the material is useful for securing further layers, e.g. a protective non-woven fabric or the like.

For storing and transportation the adhesive areas of the sealing web according to the invention are advantageously covered with a removable protective foil, which is removed on laying the material. Siliconized paper is preferably used.

In the sealing web formed from a resilient plastic pressure-sensitive adhesive and sealing compound between two flexible layers in accordance with the present invention the upper layer to a certain extent floats on the lower which significantly compensates mechanical or thermal stresses. Furthermore, this material combines the characteristics of a simple plastic foil and a plastic foil coated with a sealing compound. It can be laid wherever it is not possible to directly apply bitumen or adhesive substances, either by pouring, coating or in the form of bitumen support sheets. Compared with simple sheets, the material has self-heating properties, because the sealing compound itself closes holes in the two cover foils, e.g. of the type which can occur with the passage of individual gravel particles when laying the materials.

The use of thin individual sheets gives the overall web a very considerable flexibility, which is better than that of thick sealing webs formed from a single sheet of a comparable strength.

The manufacture of the preferred sealing web with a pressure-sensitive adhesive and sealing compound enclosed between two flexible layers can take place in particularly advantageous manner by supplying the two layer materials, e.g. two foils from above and in hopper-like manner to a roler frame with two cooled rollers and in each case in one edge area a siliconized paper strip is also supplied in overlapping manner with a somewhat greater width. The sealing compound is fed into the hopper or funnel formed by the two supplied sheets and the siliconized paper and the layer thickness of the sealing compound and simultaneously that of the finished sealing web are controlled by the spacing of the two rollers. The area on the two longitudinal sides serving to bond the sealing web during subsequent overlapping laying and the fixation strips are obtained in that the sheets do not extend up to the edge but in each case are instead replaced by the removable siliconized paper.

The invention is further illustrated hereinafter by the drawings of which

Figure 2:
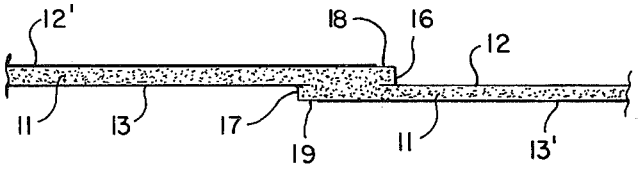

FIG. 1 shows a perspective sectional view of a sealing web according to the invention, FIG. 2 shows a section through two sealing webs according to the invention joined in an overlapping manner.

The sealing web of FIG. 1 comprises an adhesive sealing compound 11 between two sheets 12 and 13. The upper sheet 12 does not extend to longitudinal edge 17, so that in the vicinity thereof a strip of adhesive sealing compound is exposed in the longitudinal direction. Similarly, the lower sheet 13 does not extend to the opposite longitudinal edge 16, so that in the vicinity thereof there is an exposed adhesive area at the bottom. The adhesive areas at the two edges of the upper and lower faces of the sealing web are in each case covered with removable protective foils 14, 15 which are removed on laying the webs. For easier removal the protective foils 14,15 extend beyond the edges 16,17 of the sheet-like material.

When the webs are laid in overlapping manner, edge 16 comes to rest on edge 17, so that the areas of the adhesive sealing compound 11 not covered by sheets 12 and 13 directly meet one another, leading to a homogeneous, durable and waterproof joint. In FIG. 2, the adhesive areas are directly superimposed. A completely satisfactory joint is still achieved with a greater overlap of the webs, where the adhesive layers substantially directly engage with one another, but in part bonding takes place between the adhesive layer and the top sheet of the lower web.

In the embodiment shown in FIG. 2 the foils 13' and 12' opposite to the foils 12 and 13 leave a small strip 18, 19 of the adhesive composition 11 uncovered. A fixation edge is thereby formed which considerably simplifies and improves the application of the sealing webs. The fixation strip 19 at the lower face serves to secure the web to the substrate while the fixation strip 18 at the upper face can be used to secure further layers. The protective foils 14, 15 prevent the sealing webs from adhering to each other in the areas of the fixation strips during storage and transport.

What is claimed is:

1. A sheet-like sealing web for use in construction above and under ground comprising a layer of resilient elastic pressure sensitive adhesive and sealing composition having upper and lower surfaces disposed between respective upper and lower flexible layers covering a major portion of the area of said upper and lower surfaces with the longitudinal edges of said upper and lower surfaces being exposed, thereby forming first and second exposed sealing strips at opposite longitudinal edges of said upper and lower surfaces for overlap bonding of said web to adjacent identical webs and first and second fixation strips at the longitudinal edges of said upper and lower surfaces opposite said sealing strips for securing the web to a substrate or for bonding a cover material to the sealing web, said fixation strips being narrower than either of said sealing strips.

2. The sealing web of claim 1, characterized in that the resilient elastic adhesive and sealing composition has a coating thickness between 0.5 mm. and 3 mm.

3. The sealing web of claim 1, characterized in that said upper and lower flexible layers are polyolefin films with a thickness of 40 to 500 microns.

4. The sealing web of claim 1, characterized in that said first and second sealing strips each have a width of about 4 to 8 cm and said first and second fixation strips each have a width of about 0.5 to 2 cm.

5. The sealing web of claim 1, characterized in that the exposed adhesive areas are covered with a removable protective foil.

6. The sealing web of claim 1, characterized in that said upper flexible layer is selected from the group consisting of rubber sheets, plastic films, metal foils, metal coated plastic films, and laminated metal foils between two plastic films.

7. The sealing web of claim 6, characterized in that said upper and lower flexible layers are laminated plastic films.

8. The sealing web of claim 1, characterized in that said lower flexible layer is selected from the group consisting of rubber sheets, plastic films, metal foils, metal coated plastic films, laminated metal foils between two plastic films, non-woven fabrics, metal wire screen fabrics, and films lined with a non-woven fabric.

9. The sealing web of claim 1, characterized in that the adhesive and sealing composition is a bitumen or bitumen/rubber or plastic adhesive composition with pressure-sensitive adhesive properties.

* * * * *